US008157570B2

(12) United States Patent
Chen

(10) Patent No.: US 8,157,570 B2
(45) Date of Patent: Apr. 17, 2012

(54) POWER CONNECTION SOCKET UNIT SEWED ON FABRIC

(76) Inventor: Chien-Chou Chen, Tainan County (TW)

( * ) Notice: Subject to any disclaimer, the term of this patent is extended or adjusted under 35 U.S.C. 154(b) by 128 days.

(21) Appl. No.: 12/815,570

(22) Filed: Jun. 15, 2010

(65) Prior Publication Data

US 2011/0306218 A1 Dec. 15, 2011

(51) Int. Cl.
*H01R 33/00* (2006.01)

(52) U.S. Cl. ..... 439/37; 219/211

(58) Field of Classification Search ..... 439/37; 219/211, 520, 528, 529; 2/69
See application file for complete search history.

(56) References Cited

U.S. PATENT DOCUMENTS 1,691,472 A * 11/1928 Graham et al. ..... 219/211
3,443,066 A * 5/1969 Weibel ..... 219/527
5,541,388 A * 7/1996 Gadd ..... 219/211
6,324,053 B1 * 11/2001 Kamijo ..... 361/679.03
6,561,814 B2 * 5/2003 Tilbury et al. ..... 439/37
6,563,424 B1 * 5/2003 Kaario ..... 340/572.1
7,319,207 B2 * 1/2008 Campf et al. ..... 219/212
7,559,768 B2 * 7/2009 Marmaropoulos et al. ..... 439/37
7,637,040 B2 * 12/2009 Wu et al. ..... 38/89
2006/0080756 A1 * 4/2006 Goldfine ..... 2/102

* cited by examiner

*Primary Examiner* — Thanh Tam Le
(74) *Attorney, Agent, or Firm* — Rosenberg, Klein & Lee

(57) ABSTRACT

This invention relates to a power connection socket unit sewed on fabric, which is mainly sewed onto clothing or fabric object in need of connecting to power source. The socket unit has a holder for wrapping over the power connection socket and a combination sheet extending outwardly from the periphery of the holder for sewing together with the fabric, and a power cord of the socket extends out from the back of the combination sheet. In this way, when fabric or clothing is combined with electrical parts such as electric heating piece, power supply function is achieved by means of the power connection socket unit sewed on fabric or clothing. Further, the power cord is not exposed to outside so as to obtain good looking effect.

3 Claims, 7 Drawing Sheets

POWER CONNECTION SOCKET UNIT SEWED ON FABRIC

BACKGROUND OF THE INVENTION

1. Field of Invention

This invention relates to a power connection socket unit sewed on fabric, particularly to a power connection socket unit sewed on clothing for power supply thereto, in which a design having the socket wrapped and sewed on the clothing or fabric object is adapted, and the power cord being invisible so as to achieve good looking effect.

2. Brief Description of the Prior Art

Generally, apparels, hat decorations worn on human bodies or protective outfits, box bag are attached with additional functions. For example, electric heater piece is provided in apparel or gloves for warm keeping, or warm keeping device in the box bag. As power source should be used so as to achieve the above additional functions, socket for plugging to the power source should be provided on the fabric objects or apparels.

As shown in FIG. 7, the socket (20) in the attached additional structure is generally led out through a lead wire (21) and is laid aside willfully without being fixed in suitable place so that the lead wire (21) and the socket (20) stick out or falling down are often visible for ready to engage with power supply unit (22).

In view of the above fact, the inventor of the present invention hereby proposes a power connection socket unit sewed on fabric with a purpose to improve the conventional structure and disadvantages, according to his proficient experience in product development and manufacturing in relevant field, so as to achieve the object of better practical value.

SUMMARY OF THE INVENTION

The main purpose of the power connection socket unit sewed on fabric of this invention is to improve the disadvantage of bad looking having lead wire exposed to outside of the conventional structure. In other words, the power connection socket unit sewed on fabric of this invention can achieve good looking effect by allowing lead wire become invisible.

The object and effect of the power connection socket unit sewed on fabric of this invention can be realized by the following technology.

The power connection socket unit sewed on fabric of the present invention is mainly a socket unit sewed onto clothing or fabric object in need of connecting to power source, which has a holder for wrapping over the power connection socket and a combination sheet extending outwardly from the periphery of the holder for sewing together with the fabric, and a power cord of the socket stick out from the back of the combination sheet. In this way, when fabric or clothing is combined with electrical parts such as electric heating piece, power supply function is achieved by means of the power connection socket unit sewed on fabric or clothing. Further, the power cord is not exposed to outside so as to obtain good looking effect.

Further, the holder for wrapping over the power connection socket and the combination sheet extending outwardly from the periphery of the holder of the power connection socket unit sewed on fabric of the present invention can be formed by means of secondary injection molding process.

Moreover, flexible plastic material is adapted in the power connection socket unit sewed on fabric of the present invention to wrap over the power connection socket. In this manner, it becomes easier and more convenient in the process of sewing the unit onto the apparels.

DETAILED DESCRIPTION OF PREFERRED EMBODIMENTS

The objects, the technical contents and the expected effect of the present invention will become more apparent from the detailed description of preferred embodiments in conjunction with the accompanying drawings.

Figure 1:
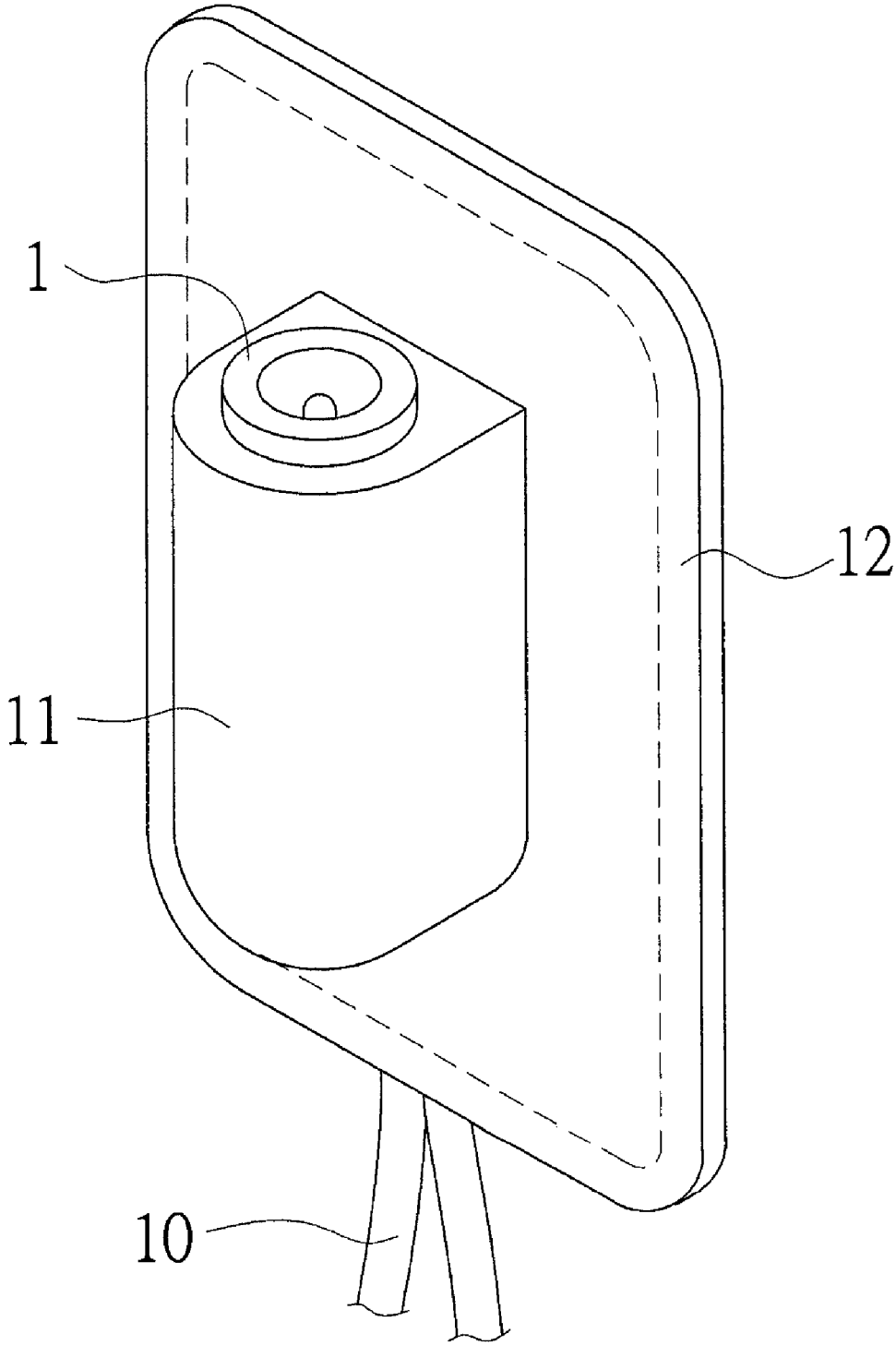
FIG. 1 is a perspective outline view showing the power connection socket unit sewed on fabric according to the present invention.
Figure 2:
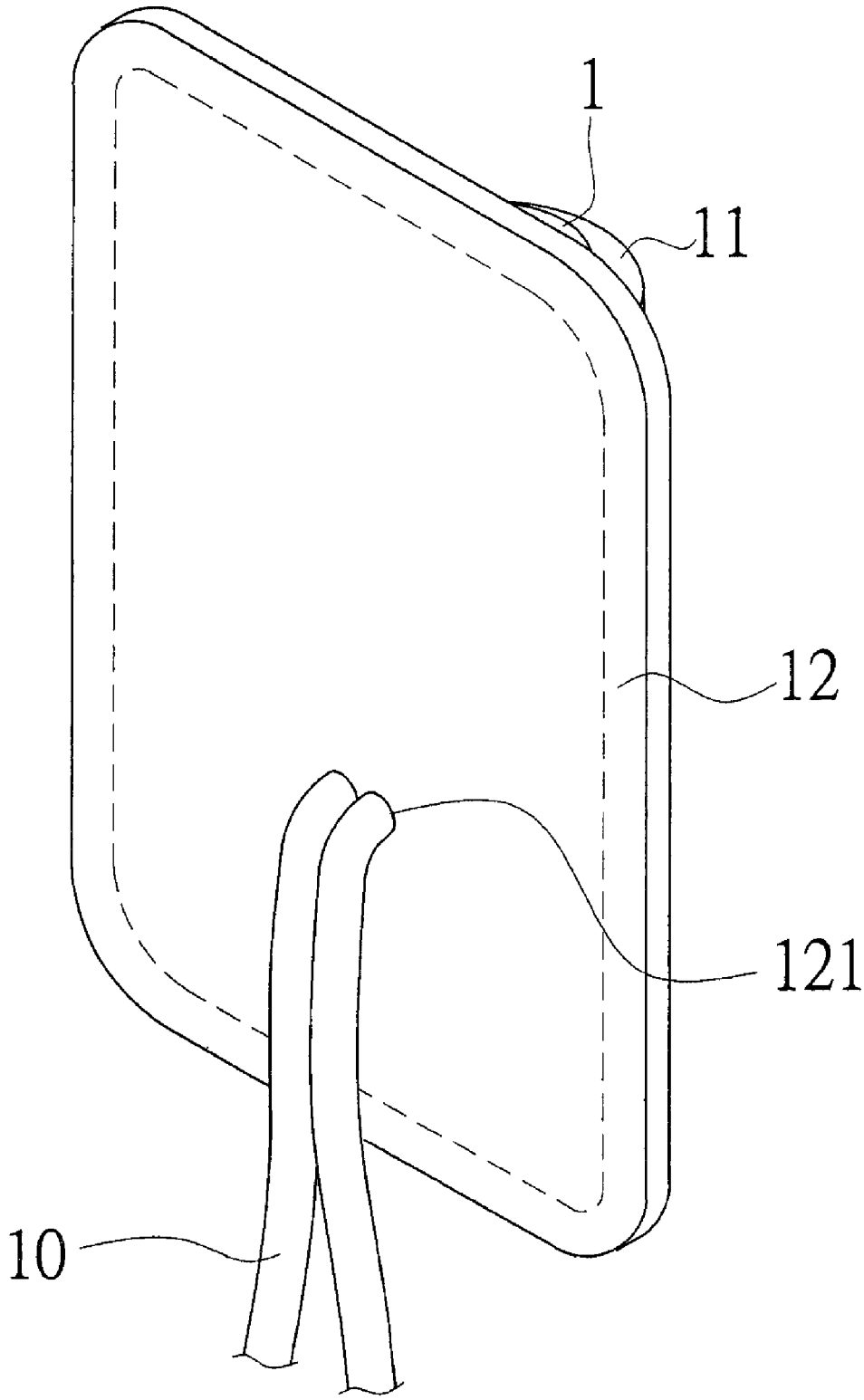
FIG. 2 is a rear schematic view showing the power connection socket unit sewed on fabric according to the present invention.
Figure 3:
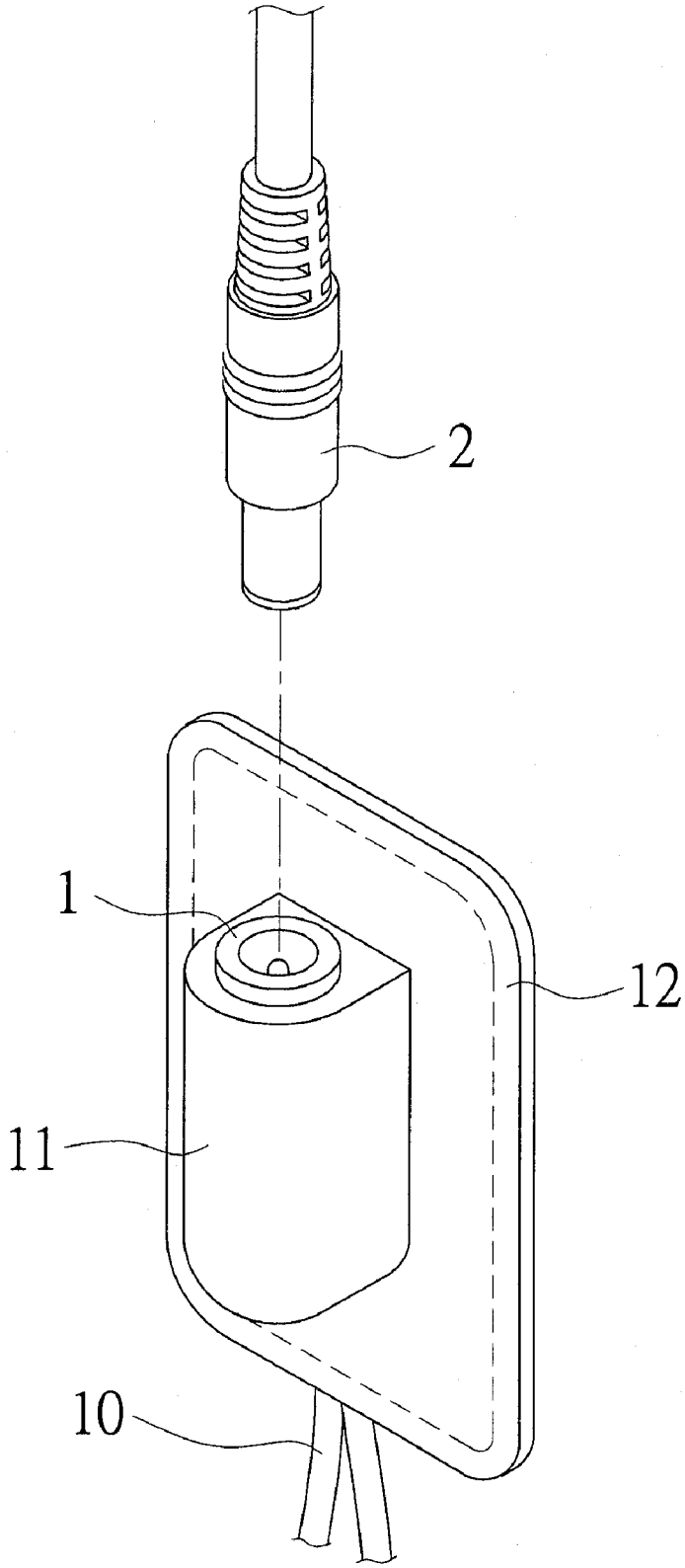
FIG. 3 is an exploded schematic view showing the power connection socket unit sewed on fabric according to the present invention in usage.
Figure 4:
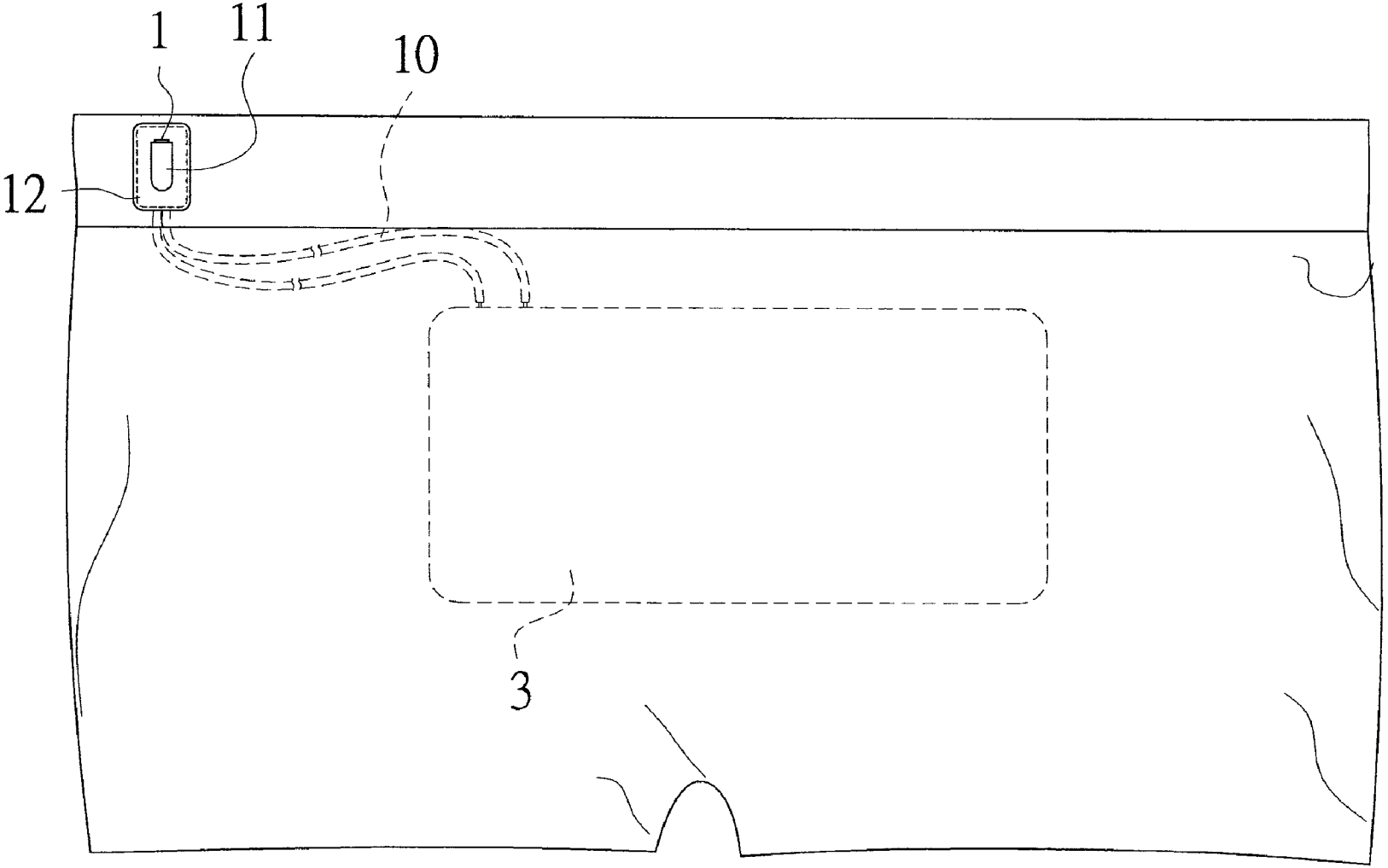
FIG. 4 is a schematic view showing the first embodiment of the power connection socket unit sewed on fabric according to the present invention in usage state.
Figure 5:
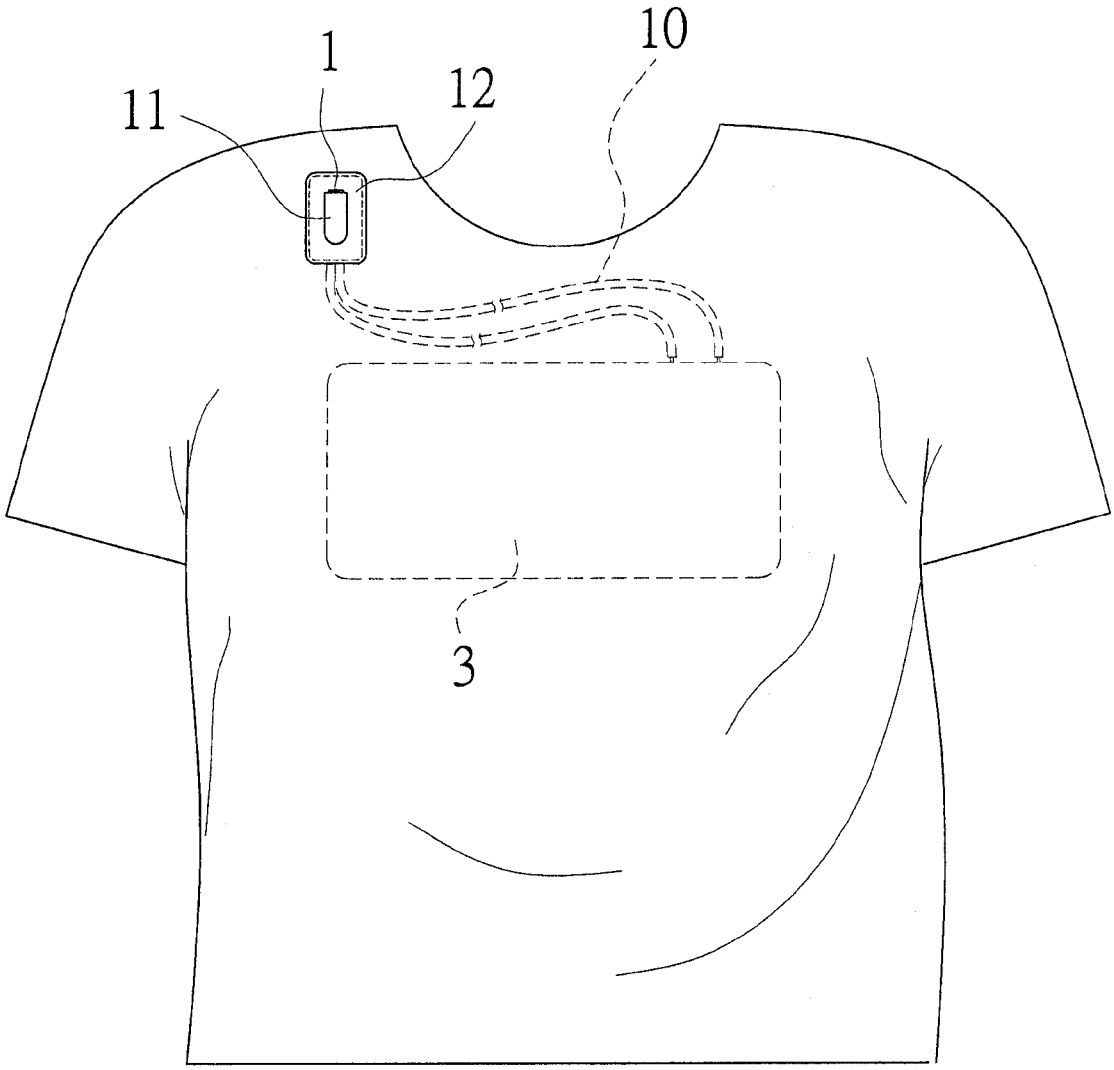
FIG. 5 is a schematic view showing the second embodiment of the power connection socket unit sewed on fabric according to the present invention in usage state.
Figure 6:
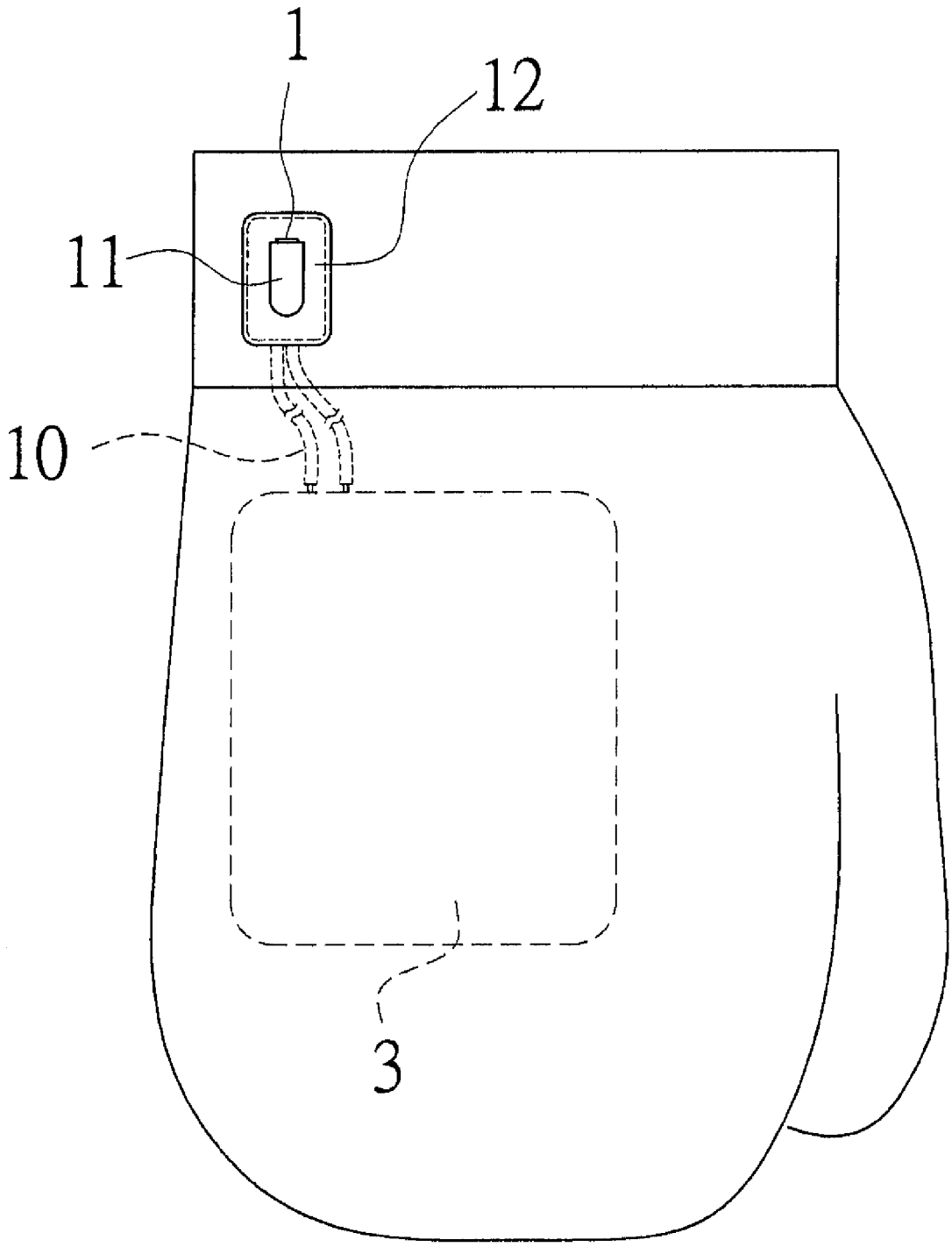
FIG. 6 is a schematic view showing the third embodiment of the power connection socket unit sewed on fabric according to the present invention in usage state.
Figure 7:
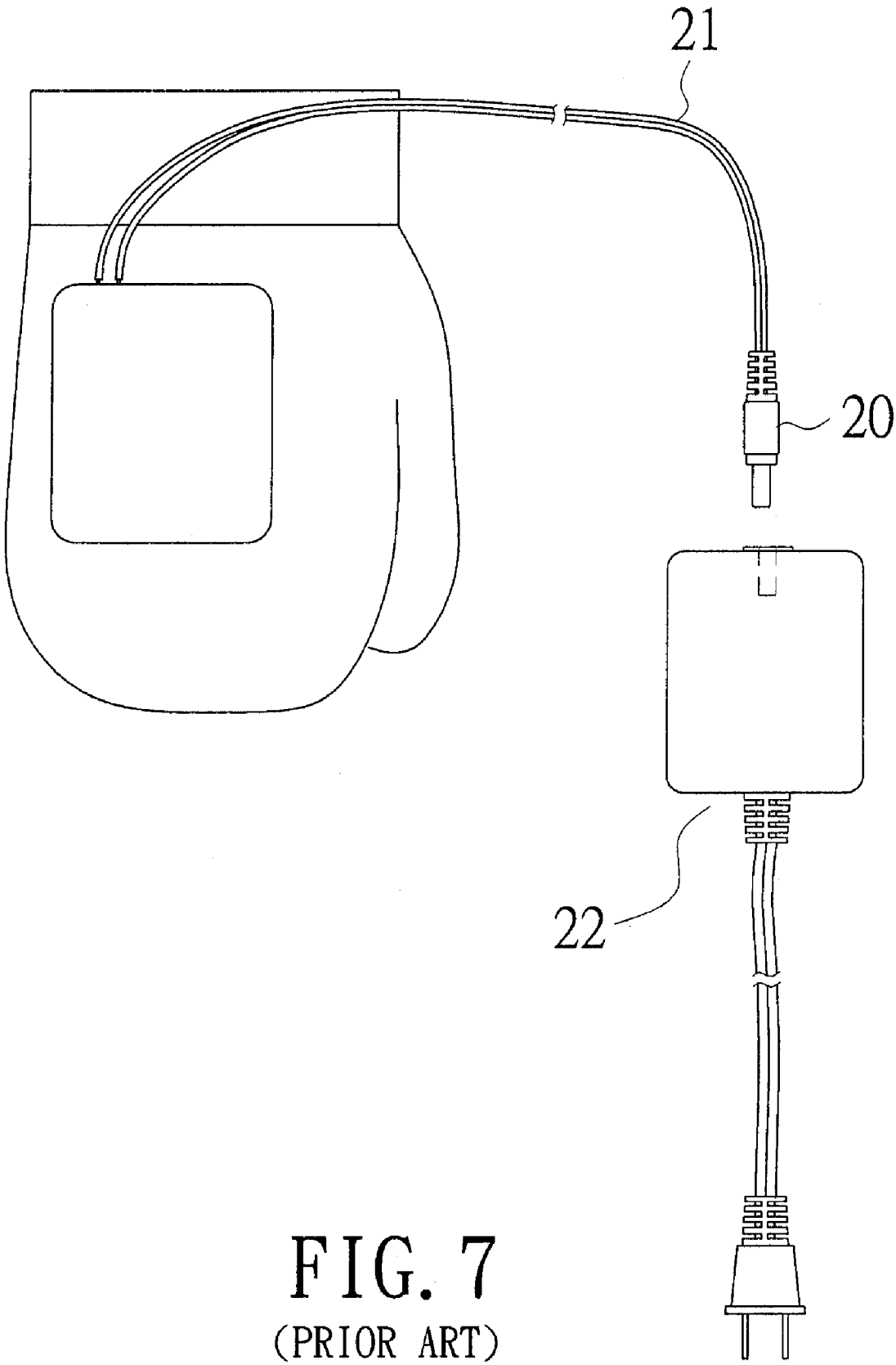
FIG. 7 (PRIOR ART)
FIG. 7 is a schematic view of a prior art.

Firstly, FIGS. 1 to 3 are respectively perspective schematic view, rear view and exploded schematic view showing the power connection socket unit sewed on fabric of the present invention. As shown in these figures, the socket unit has a holder (11) for wrapping over the power connection socket (1) and a combination sheet (12) extending outwardly from the periphery of the holder for sewing together with the fabric, and the combination sheet (12) having slots (121) provided on its back for the passing-through of a power cord (10) of the socket (1).

Referring to FIGS. 1 to 6, the combination sheet (12) of the power connection socket (1) is sewed on the fabric object according to its need, such as apparels, trousers, underwear, gloves, protective outfits, box bag fabrics. In this embodiment, underwear, apparels, and gloves are shown in the figures as examples. When electric heating piece (3) for warm keeping is attached to the above fabrics, the combination sheet (12) of the power connection socket (1) is sewed on appropriate place on the fabric object, and the power cord (10) stick out from the back of the combination sheet (12) is connected with the electric heating piece (3). In turn, the socket (1) wrapped within the holder (11) is engaged with a plug (2) on the power source side so as to supply required power to the electric heating piece (3) for heating.

Further, the holder (11) for wrapping over the power connection socket and the combination sheet (12) extending outwardly from the periphery of the holder (11) of the power connection socket unit sewed on fabric of the present invention can be formed by means of secondary injection molding process. Moreover, flexible plastic material is utilized to wrap over the power connection socket (1) in secondary injection molding process. In this manner, it becomes easier and more convenient in the process of sewing the unit onto the apparels.

Based on foregoing, when apparels or fabric objects are combined with power dependent unit such as electric heating piece or the other warm keeping apparatus, power supply function can be accomplished by the power connection socket unit sewed on fabric according to the present invention. In this manner, the power cord is not exposed to outside so as to obtain good looking effect.

It is noted that the above embodiment or drawings are not intended to restrict product aspect or dimensions of the present invention. Various modifications and variations conducted by the person having general knowledge in the field are considered to be within the scope of the present invention which is defined by the appended claims.

Summing up above, the power connection socket unit sewed on fabric according to the present invention has various advantages when comparing with prior art.

1. The power connection socket unit sewed on fabric according to the present invention has a holder for wrapping over the power connection socket and a combination sheet extending outwardly from the periphery of the holder for sewing together with the fabric. It can be combined with various fabric objects in need of power supply so as to achieve widespread application.

2. With the same reason as above, the power connection socket unit sewed on fabric according to the present invention has good looking effect which is achieved by leading the power cord out from the back of the combination sheet.

Summing up above, the present invention can reach expected effectiveness, and the specific structures disclosed herein have yet not seen in the prior art of the same category of product, even has not been opened to the public before application.

What is claimed is:

1. A power connection socket unit sewed on fabric, which is mainly a socket unit sewed onto clothing or fabric object in need of connecting to power source, wherein said socket unit has a holder for wrapping over the power connection socket and a combination sheet extending outwardly from a periphery of said holder for sewing together with the fabric, said combination sheet having slots provided on a back surface for the passing-through of a power cord of said power connection socket, wherein the power cord being covered by the fabric.

2. The power connection socket unit sewed on fabric as claimed in claim 1, wherein said holder for wrapping over said power connection socket and said combination sheet extending outwardly from the periphery of said holder are formed by means of an injection molding process.

3. The power connection socket unit sewed on fabric as claimed in claim 2, wherein flexible plastic material is utilized to wrap over the power connection socket in the injection molding process.

* * * * *